US007195118B2

(12) United States Patent
Sutherland

(10) Patent No.: US 7,195,118 B2
(45) Date of Patent: Mar. 27, 2007

(54) BEVELED CORNER CARTON WITH AN INTERLOCKING SEPARATOR PAD

(75) Inventor: Robert L. Sutherland, Kennesaw, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 407 days.

(21) Appl. No.: 10/770,882

(22) Filed: Jan. 30, 2004

(65) Prior Publication Data

US 2005/0167292 A1 Aug. 4, 2005

(51) Int. Cl.
*B65D 5/49* (2006.01)

(52) U.S. Cl. ..... 206/170; 206/427; 229/120.32; 229/120.38

(58) Field of Classification Search ..... 229/120.32, 229/120.38, 121, 122, 122.1, 240–242; 206/427, 206/429–430, 434; 221/303, 305, 306, 309
See application file for complete search history.

(56) References Cited

U.S. PATENT DOCUMENTS

| | | | | |
|---|---|---|---|---|
| 1,896,326 | A | | 2/1933 | Northway-Ley |
| 1,898,646 | A | | 2/1933 | Taylor |
| 2,875,942 | A | | 3/1959 | Wilson |
| 3,822,785 | A | | 7/1974 | Getz et al. |
| 4,120,443 | A | | 10/1978 | Gardner et al. |
| 4,421,229 | A | * | 12/1983 | Pan et al. ..... 206/750 |
| 4,577,799 | A | | 3/1986 | Oliff |
| 5,415,344 | A | | 5/1995 | Harrelson |
| 5,427,242 | A | | 6/1995 | Oliff et al. |
| 5,682,984 | A | | 11/1997 | Hoell et al. |
| 5,772,030 | A | | 6/1998 | Baxter |

(Continued)

FOREIGN PATENT DOCUMENTS

| | | |
|---|---|---|
| CH | 263456 | 8/1949 |

(Continued)

*Primary Examiner*—Mickey Yu
*Assistant Examiner*—Jerrold Johnson
(74) *Attorney, Agent, or Firm*—Womble Carlyle Sandridge & Rice, PLLC

(57) ABSTRACT

A carton with bevel corners for carrying cans, or other articles, which has an interlocking separator pad so the cans or articles can be contained in two layers is provided. The carton has two ends, each of which is closed by two side end closures and top and bottom end flaps. Each side end closure has an aperture that is interlocked with the end portion of an interlocking separator pad. In one embodiment of this invention, the interlocking separator pad has two tabs with the aperture in each side end closure being a slot through which a tab is extended. This pad may have a foldably attached leading flap that is lodged between cans or articles contained in the carton and the side end closures. In another embodiment of this invention, the aperture in each side end closure is a slit with the interlocking separator pad having a leading flap which extends through the slits on the side end closures on an end of the carton and folded up or down and lodged between the side end closures and the top end flap or bottom end flap. The interlocking of the separator pad with the apertures in the side end closures prevents the pad from shifting as cans are removed from the carton. Both of these embodiments may have a dispenser in the side panel for the removal of cans or articles inside.

39 Claims, 9 Drawing Sheets

U.S. PATENT DOCUMENTS

| | | | |
|---|---|---|---|
| 5,826,783 | A | 10/1998 | Stout |
| 5,868,252 | A | 2/1999 | Oliff |
| 5,938,109 | A | 8/1999 | Sainz et al. |
| 6,991,107 | B2 | 1/2006 | Harrelson |

FOREIGN PATENT DOCUMENTS

| | | | |
|---|---|---|---|
| DE | 88 14 144 6 | | 1/1989 |
| DE | 91 11 941.3 | | 2/1992 |
| EP | 595602 | A1 * | 5/1994 |
| FR | 1.427.897 | | 4/1966 |
| FR | 1.489.087 | | 7/1967 |
| FR | 1.497.652 | | 10/1967 |
| FR | 2.223.985 | | 10/1974 |
| GB | 434145 | | 8/1935 |
| GB | 2 198 709 | A | 6/1988 |
| GB | 2 323 352 | | 9/1998 |
| JP | 7-125745 | | 5/1995 |
| JP | 9-142449 | | 6/1997 |
| JP | 11-130049 | | 5/1999 |
| JP | 2000-85754 | | 3/2000 |
| WO | WO 96/29261 | | 9/1996 |
| WO | WO 02/030764 | A3 | 4/2002 |

* cited by examiner

BEVELED CORNER CARTON WITH AN INTERLOCKING SEPARATOR PAD

BACKGROUND OF THE INVENTION

1. Field of the Invention

The present invention relates generally to a carton with beveled corners for carrying cylindrical containers or other types of articles in two layers, with each layer having two or more rows. An interlocking divider pad, or separator pad, is provided which interlocks with the side end flaps on both ends of the carton. This carton may have a dispenser in a side panel to permit easy access and removal of the containers in the carton.

2. Background

Fully enclosed cartons that are capable of carrying cans have been used in the past that have a feature for dispensing the cans one at a time. Many of these dispensers do not work in a satisfactory fashion when the cans are carried in two layers. It is desirable to carry cans of certain products in two layers, especially when the can size is small it would be desirable to have a dispenser that would permit the dispensing of cans from each layer in a carton that contains two layers of cans. It would be desirable to have a divider, or separator, pad separating the two layers of cans in order for the dispenser on the carton to work properly. Otherwise, the cans in one layer could interfere with the dispensing of cans in the other layer. It would also be desirable to have a divider, or separator, pad that would remain in place during the dispensing of all cans in the carton. It would also be desirable to have a divider, or separator, pad that would work with a carton with beveled corners with the dispenser in the side panel of the carton.

SUMMARY OF THE INVENTION

Briefly described, the present invention relates to a fully enclosed carton that is capable of carrying two layers of cans or other articles which has an interlocking separator, or divider, pad separating the two layers of cans or other articles. The carton has a bottom panel, top panel and foldably attached side panels. The carton of this invention has beveled corners which permits a tighter package and saves paperboard when packaging cylindrical containers. Each end of the carton is closed by a top end flap and bottom end flap and a pair of side end closures, each of which has an angle panel attached to a side panel and a side end flap attached to the angle panel. Each end of the carton is closed by closing the angle panels and side end flaps and securing the top end flap and bottom end flap to the side end flaps.

An interlocking divider pad, or separator pad, separates the articles, such as cylindrical containers, into two layers. The separator pad is interlocked with the carton. The separator pad has an end portion on each end which is interlocked through an aperture in each end closure. The separator pad has a leading flap on one end which is folded into a plane perpendicular to the bottom panel of the carton. Each end of separator pad may have a leading flap.

In one embodiment of this invention, each end of the separator pad has two or more tabs which are extended through slots in the end closures. This separator pad has a leading flap that is folded up or down between the articles or containers contained in the carton and the end closures. This leading flap helps keep the separator pad in the proper position during the removal of an article or container from the carton through a dispenser opening.

In another embodiment of this invention, each side end flap on each end of the carton has a slit through which a leading flap on the separator pad is extended and folded up or down. This leading flap is sandwiched between the top or bottom end flaps and the side end flaps, thus holding separator pad in a fixed position in the carton.

The ends of the carton formed from each embodiment discussed above can be held together by gluing the top end flap and bottom end flap on each end of the carton to the side end flaps.

The carton and interlocking separator pad of this invention is used to carry two layers of cans or other articles, with each layer having two or more rows. Cans are arranged in a group with the interlocking separator pad placed on top of the group of cans and another group of cans is stacked on top of the interlocking separator pad. The two layers of cans are then pushed into the carton and the interlocking separator pad is locked to the carton.

This carton may have a dispenser for dispensing cans from each layer one at a time. One type of dispenser may be located in the side panel for dispensing cans from the carton when the carton is resting on the end adjacent to the dispenser. This dispenser can be formed by two parallel tear lines forming a dispenser flap in the side panel with these parallel tear line extending across the side panel and into the adjoining top and bottom panels where the bottom and top tear lines are interconnected. These tear lines are spaced apart by a distance approximately equal to the diameter of a can to be carried in the carton. A tear line may interconnect the top and bottom tear lines in the side panel and have a finger flap foldably attached to each side of the tear line which essentially divides the flap into two portions. These finger flaps can be pushed in to enable a person to grasp the two portions of the flap and pull them open forming the dispenser opening for dispensing cans from each layer. The bottom tear line for forming the dispenser flap is spaced close enough to the end of the carton upon which it rests during dispensing to prevent cans from rolling out of the opening. This bottom tear line should not be placed so far from this end of the carton as to make it difficult to remove cans immediately adjacent this end of the carton. Preferably the tear lines interconnecting the top and bottom tear lines in the bottom panel and in the top panel are curved like the cans are curved to permit the easy grasping of the end of a can when the dispenser flap has been removed. For most cans this bottom tear line need only be located approximately one inch from the end of the carton on which it is resting during dispensing. A tear line may be provided in the top panel and in the bottom panel between the bottom tear line and the end of the carton on which the carton rests when cans are being dispensed to form a ledge between the bottom tear line and the end of the carton. If these tear lines between the bottom tear line and the end of the carton are tom open, and the ledge moved forward, it will provide less resistance to the removal of cans from the dispenser opening. Having a dispenser opening in a side panel of the carton for dispensing cans while the carton rests upon its end adjacent the dispenser opening provides a large display area in the side panel above the dispenser for advertising to the consumer.

This carton may have a carrying handle formed by two fingers holes in the top panel. These cartons may be constructed by gluing, taping, stapling and the like. A carton may have two dispensers. Preferably, only one dispenser is used in a carton.

While this carton can be used to carry various types of articles, it is especially designed for carrying cylindrical containers, such as cans, because of the use of bevel corners in the carton which allows the carton to be tightly packed around the cylindrical containers.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENTS

The present invention is primarily for use with cans of the type used to contain meat products, vegetables and fish. The carton of this invention is primarily useful for cans that are stacked in the carton in two layers with two of more rows in each layer. These cans typically only have a height of two or three inches, and typically these cans are stacked in a carton in two layers of twelve cans in each layer.

Figure 1:
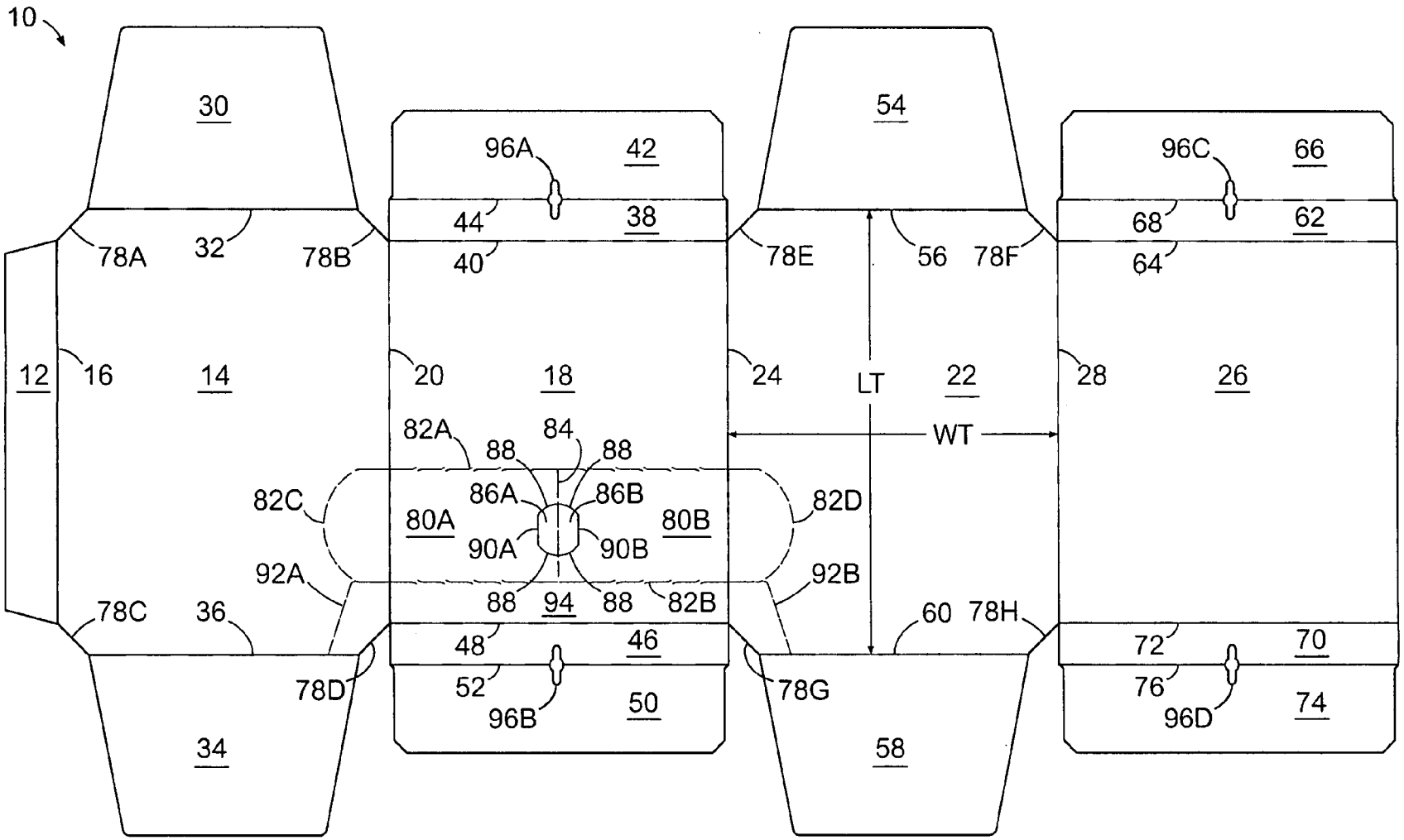
FIG. 1 is a plan view of a blank of which a carton according to one embodiment of this invention is constructed.
Figure 1A:
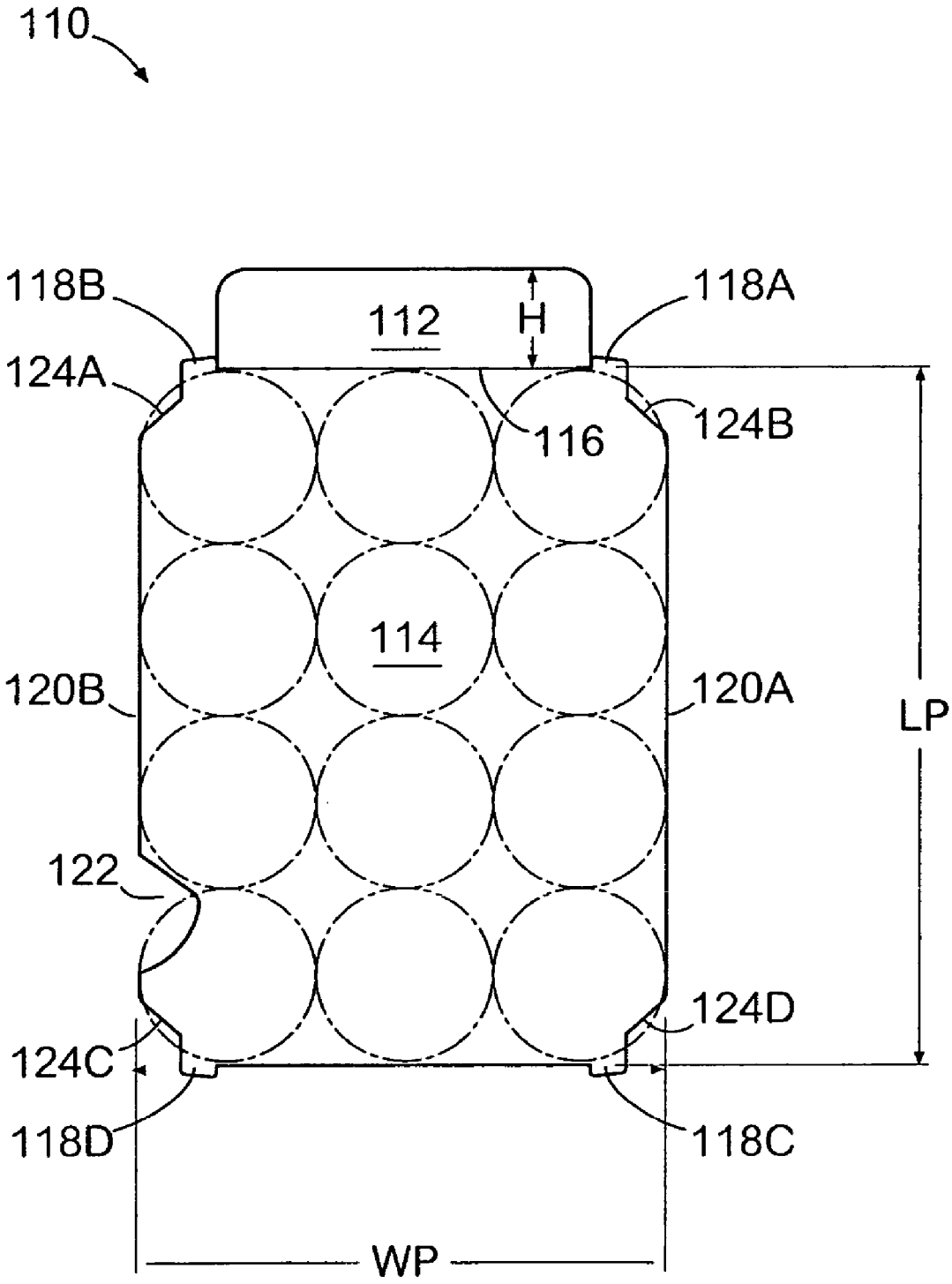
FIG. 1A is a plan view for an interlocking separator pad according to one embodiment of this invention.
Figure 5:
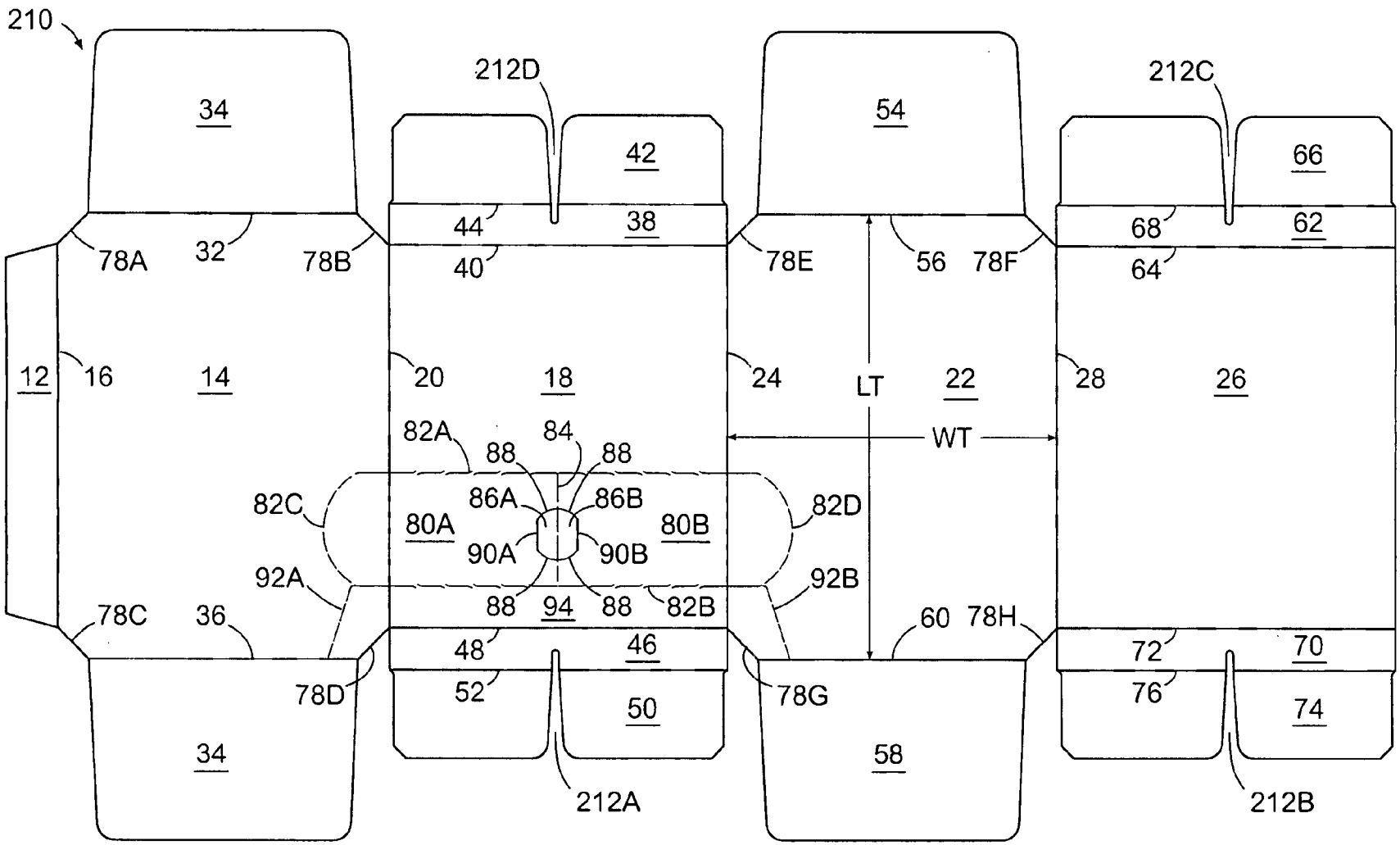
FIG. 5 is a plan view of a blank of which a carton according to another embodiment of this invention is constructed.
Figure 5A:
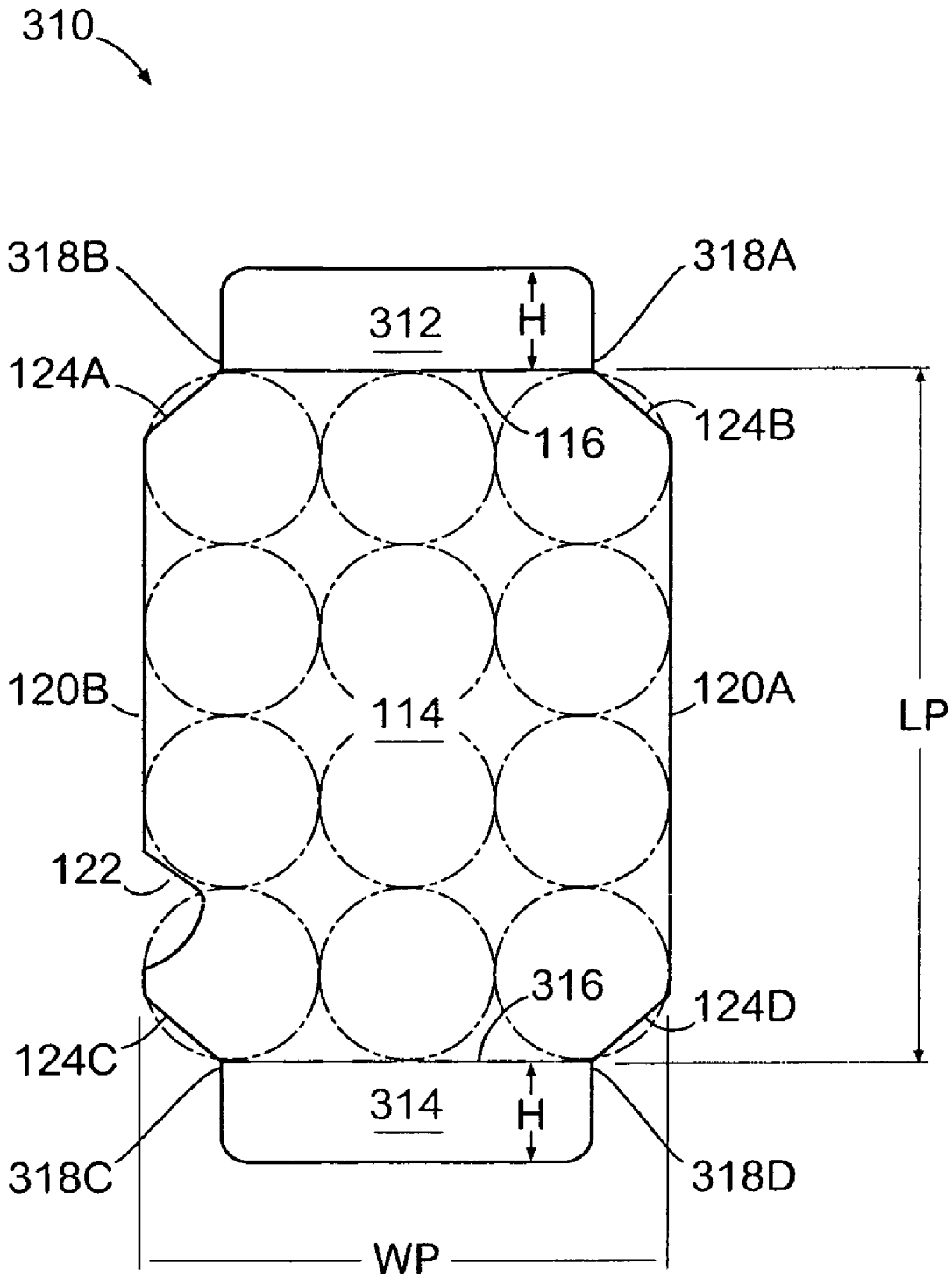
FIG. 5A is a plan view for an interlocking separator pad according to another embodiment of this invention.

As illustrated in FIGS. 1 and 5, the blanks 10 and 210 for forming the cartons of this invention are formed from a foldable sheet of material, such as paperboard. The blanks 110 and 310 for forming the interlocking separator pad are also formed from a foldable sheet of material, such as paperboard, as illustrated in FIGS. 1A and 5A.

The blank 10 for forming the carton of this invention has a glue flap 12 which is attached to bottom panel 14 by fold line 16 and interconnected to side panel 18 by fold line 20. Side panel 18 is connected to top panel 22 by fold line 24, and interconnected to opposite side panel 26 by fold line 28.

Bottom panel 14 is connected to bottom end flap 30 by fold line 32 and connected to opposite bottom end flap 34 by fold line 36. Side panel 18 is connected to side angle panel 38 by fold line 40 and in turn connected to side end flap 42 by fold line 44. On the other end of the carton, side panel 18 is connected to side angle panel 46 by fold line 48 and in turn connected to opposite side end flap 50 by fold line 52.

Top panel 22 is connected to top end flap 54 by fold line 56 and the opposite top end flap 58 by fold line 60. The opposite side panel 26 is connected to side angle panel 62 by fold line 64 and in turn connected to side end flap 66 by fold line 68. A side angle panel and adjoining side end flap (e.g. 62 and 66) constitute a side end closure. On the other end of the carton, opposite side panel 26 is connected to side angle panel 70 by fold line 72 and in turn connected to opposite side end flap 74 by fold line 76.

Figure 4:
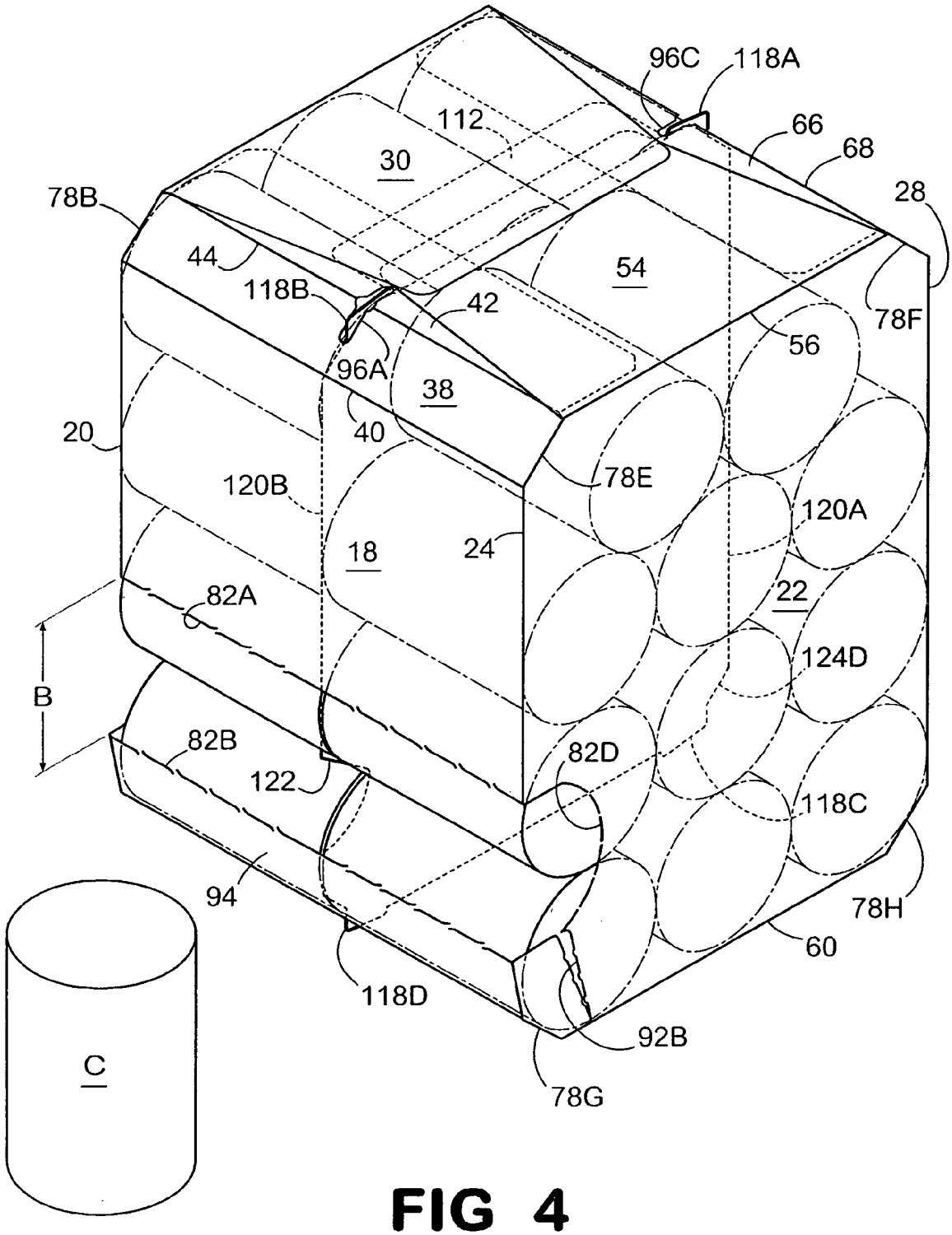
FIG. 4 is a perspective view of the closed carton of FIG. 3 which shows the carton resting on its end in which the side dispenser has been opened.

Bottom panel 14 and top panel 22 have an angled corner 78A–H at each corner of the panel. This carton may have a dispenser opening B in a side panel as best illustrated in FIG. 4. The dispenser opening B may be made available by providing a side dispenser flap, shown in two portions 80A–B, in the side panel 18 that extends into the bottom panel 14 and top panel 22 as shown in FIG. 1. This side dispenser flap 80A–B is formed by top tear line 82A and bottom tear line 82B which are parallel to each other in side panel 18 and are interconnected by interconnecting tear lines 82C and 82D. These two portions 80A and 80B can be formed as a single flap, but for ease of opening it is preferred to have two portions. Finger flaps 86A and 86B may be provided along middle tear line 84 which separates portions 80A and 80B to assist in opening these portions. Finger flap 86A is attached to portion 80A by fold line 90A and finger flap 86B is attached to portion 80B by fold line 90B. Finger flaps 86A and 86B are formed by providing cut lines 88.

To facilitate removing cans from the dispenser opening B (as shown in FIG. 4) after portions 80A and 80B have been removed, ledge tear lines 92A and 92B may be provided to permit the movement of ledge 94 formed between bottom tear line 82B and fold line 48 to ease the removal of cans through the dispenser opening B.

In order to interlock the separator pad 114 to the carton, a slot 96A–D may be provided in each side end closure. This slot may be formed in the side end flap (e.g., 42) or the slot (e.g. 96A) may be formed so that it extends into both a side end flap and side angle panel (e.g. 42 and 38 as shown in FIG. 1). The slot is preferably centered on the fold line (e.g. 44) between the side end flap and side angle panel. The function of these slots 96A–B will be explained infra. These slots 96A–D are located from the bottom panel 14 of the carton at the height of the articles or containers to be placed in the bottom layer in the carton. In other words, the slots are located so that the interlocking separator pad can be placed between the two layers of articles or cans to be contained in the carton.

A blank 110 for forming an interlocking separator pad for the carton formed from blank 10 is illustrated in FIG. 1A. This blank 110 has a leading flap 112 which is foldably attached to separator pad 114 by fold line 116. The separator pad 114 has two tabs 118A and 118B on this end of the pad and tabs 118C and 118D on the other end of the pad. The separator pad 114 has angled corners 124A–D, whose function will be explained infra. The separator pad 114 may have a cut out 122 to facilitate the removal of articles or cans from the carton through the dispenser opening B. The width WP between the edges 120A and 120B of separator pad 114 must be at least slightly less than the width WT of the top panel 22 between fold lines 24 and 28 of the carton made from the blank of FIG. 1. The length LP of the separator pad 114 must be approximately the same length as the length LT of the top panel 22 between fold lines 56 and 60. The height H of the leading flap 112 must not be greater than the articles or cans to be contained in the carton or it can not be properly folded into position.

Figure 2:
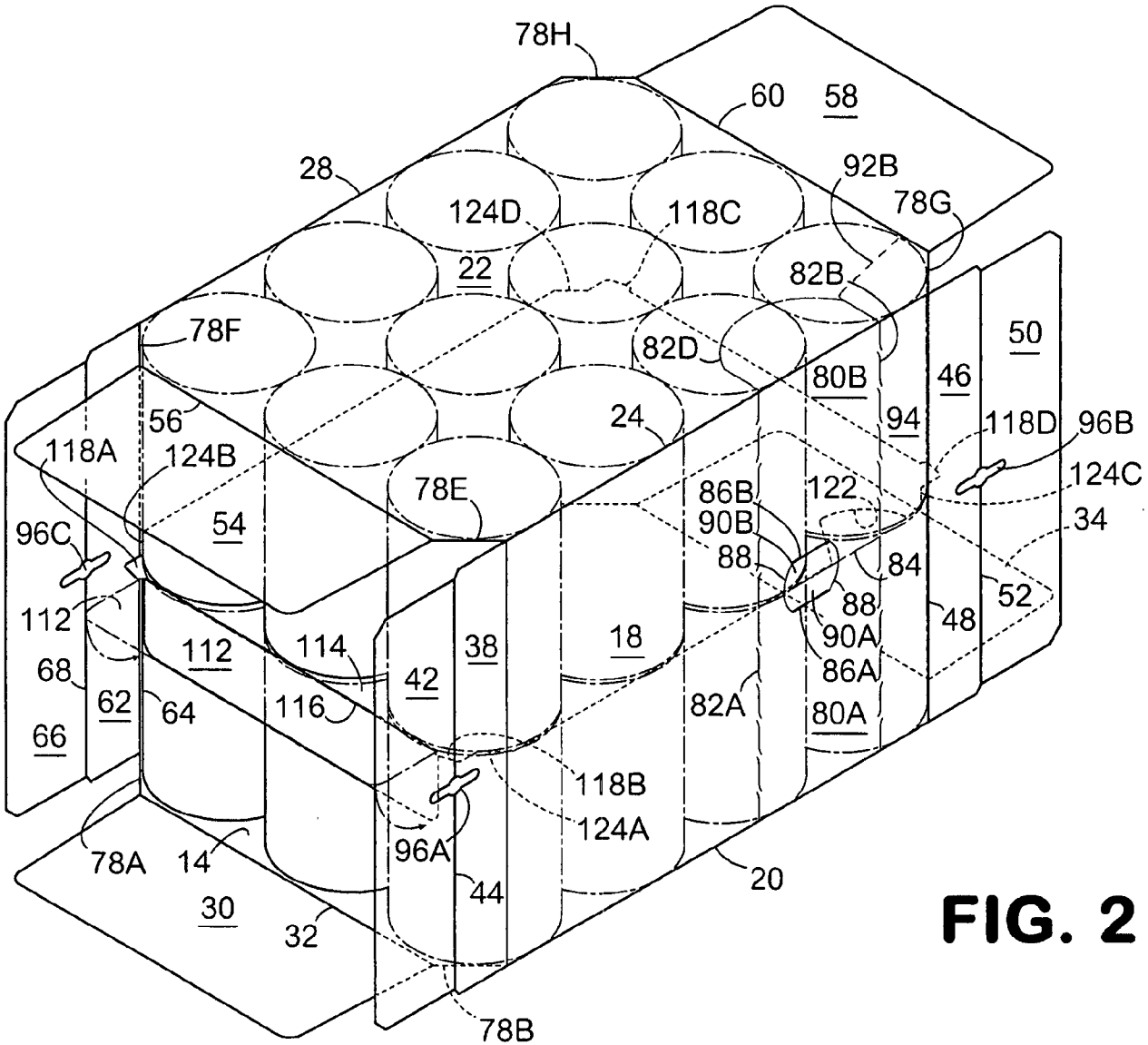
FIG. 2 is a perspective view of the end of a carton formed from the blank of FIG. 1 with the separator pad of FIG. 1A placed between two layers of cans which have been loaded into the carton. This view shows how the leading flap is folded down.
Figure 3:
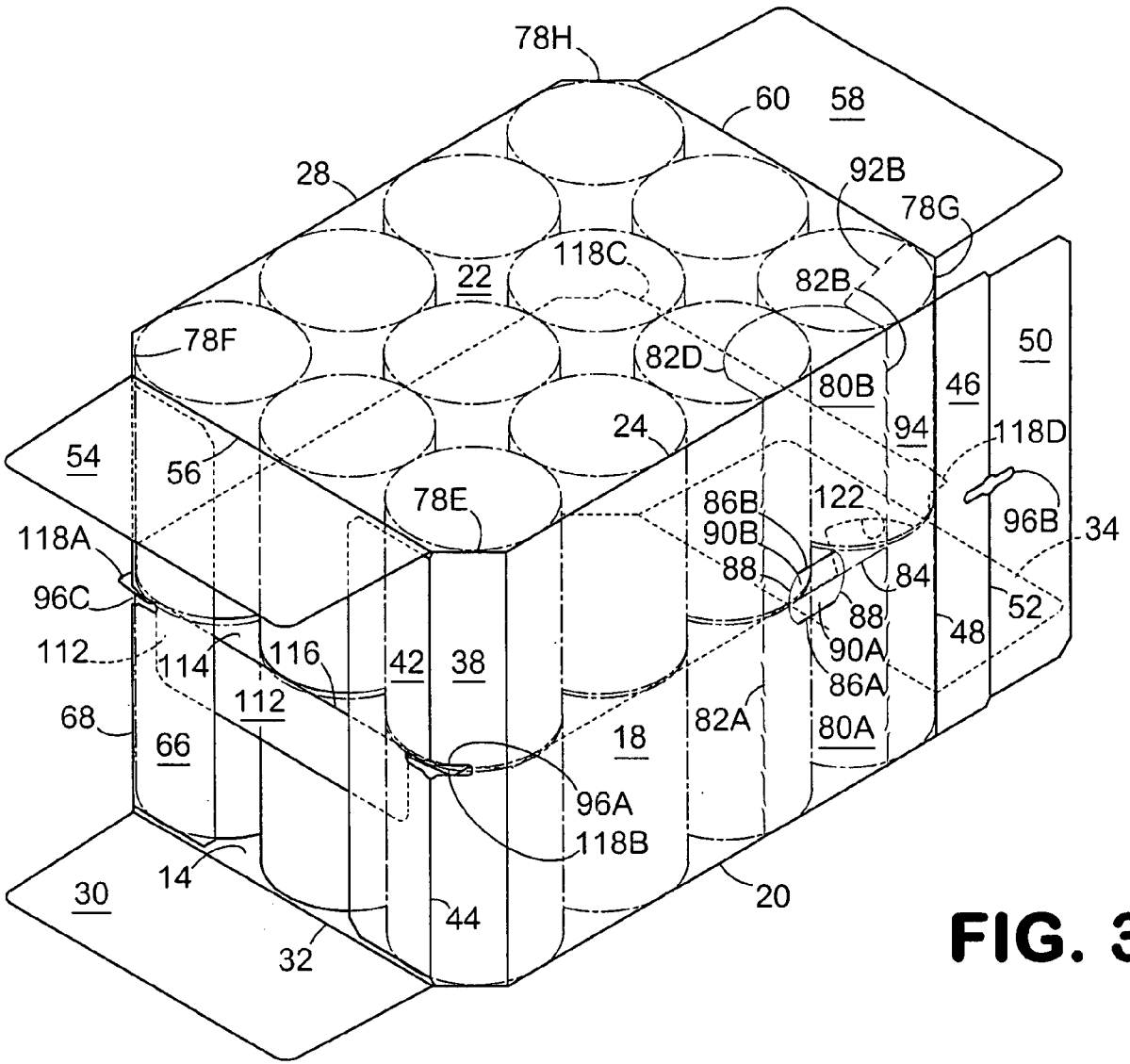
FIG. 3 is perspective end view of the carton shown in FIG. 2 in which the leading flap has been folded down and the side end flaps and angle panels on one end of the carton have been closed showing two tabs on the pad extending through slots in the flaps and panels.

The blank 10 of this embodiment is formed into a carton sleeve by gluing glue flap 12 to opposite side panel 26 to form a sleeve as illustrated in FIG. 2. The blank 110 for the interlocking separator pad 114 is placed on top of three rows of cans in one layer as illustrated in FIGS. 2 and 3. In loading the carton, the leading flap 112 is folded down and the bottom layer of cans is pushed into the carton as illustrated in FIG. 2. It is possible to have only two rows of articles or cans or to have more than three rows in each layer. A second layer with three rows of cans can then be placed on top of the separator pad 114 or placed on the separator pad 114 before insertion into the carton. Each side end closure, which consists of a side angle panel and adjoining side end flap is then closed. As illustrated in FIG. 3, the closing of side end flap 66 and adjoining side angle panel 62 results in tab 118A of the separator pad 114 projecting through slot 96C as shown in FIG. 3. When the end closure is closed, the angle panel 62 as shown in FIGS. 2 and 3 closes against the angled corner 124B of the separator pad 114 and the angled corner 78F of the top panel 22 and 78B of the bottom panel 14. This results in a tightly packed, carton when the cans are packaged. Side angle panel 62 cuts off what otherwise would be an empty corner of the carton. The side angle panel 62 is immediately adjacent a portion of the circumference of the can. Angled corner 124B on the separator pad 114 allows the carton to be tightly packed with cylindrical containers. The use of a carton with side angle panels not only enables the carton to be more tightly packed with containers, but also reduces the amount of paperboard required.

As illustrated in FIG. 3, the tab 118A of the separator pad 114 only projects a slight distance beyond slot 96C. This is important when the slot is placed in both a side angle panel and the adjoining side end flap as shown in FIG. 1. The projection of the tab beyond the side angle panel by any significant distance could interfere with the stacking and handling of cartons. The slot could be placed entirely in a side end flap, in which case the tab could be folded up or down prior to the final closing of the carton by the top end flap and, the bottom end flap. As illustrated in FIG. 3 the tab 118A has a thickness and width that is only slightly less than the thickness and width of the slot 96C through which it projects. The tabs 118A–D prevent the separator pad 114 from moving towards the bottom panel or top panel when cans are removed from the carton through the dispenser. The carton can be closed by folding bottom end flap 30 and top end flap 54 and gluing them to side end flaps 42 and 66. The other end of the carton is closed in the same manner. The leading flap 112 on the separator pad 114 is lodged between the cans and the side end flaps. The leading flap 112 helps hold the separator pad 114 in the proper position as cans are removed from the dispenser. It also holds the separator pad 114 between the two layers of cans when the other end of the carton is opened. If desired, a leading flap like leading flap 112 can be placed on the other end of the separator pad 114 to further ensure the maintenance of the proper position of the separator pad in the carton as it is being emptied of cans. The leading flap 112 can be folded either up or down as the top panel 22 and bottom panel 14 of the carton are identical. The tabs 118A–D which project through the slots 96A–D on each end of the carton and the leading flap 112 hold the separator pad 114 in the interlocked position without the necessity of gluing the separator pad to the carton. This eliminates another step that would otherwise be required in the loading of a carton with cans.

As illustrated in FIG. 4, the dispenser opening B can be used when the carton with cans is resting on the end of the carton adjacent to the dispenser opening. The dispenser opening B can be formed by removing portions 80A and 80B. The dispenser flap can be easily opened by pushing in fingers flaps 86A and 86B and tearing portions 80A and 80B along top tear line 82A and bottom tear line 82B and removing the flap. A can C can be removed from each layer of cans as shown in FIG. 4. The distance between top tear line 82A and bottom tear line 82B should be approximately equal to the diameter of a can. Preferably the distance between bottom tear line 82B and fold line 48 is approximately one inch for many sizes of cans. The distance between bottom tear line 82B and fold line 48 should be significantly less than the diameter of a can to prevent cans from automatically rolling out of the carton when the dispenser opening B is open. The dispenser ledge 94 between the bottom tear line 82B and fold line 48 can be moved forward by tearing along ledge tear lines 92A and 92B.

Figure 6:
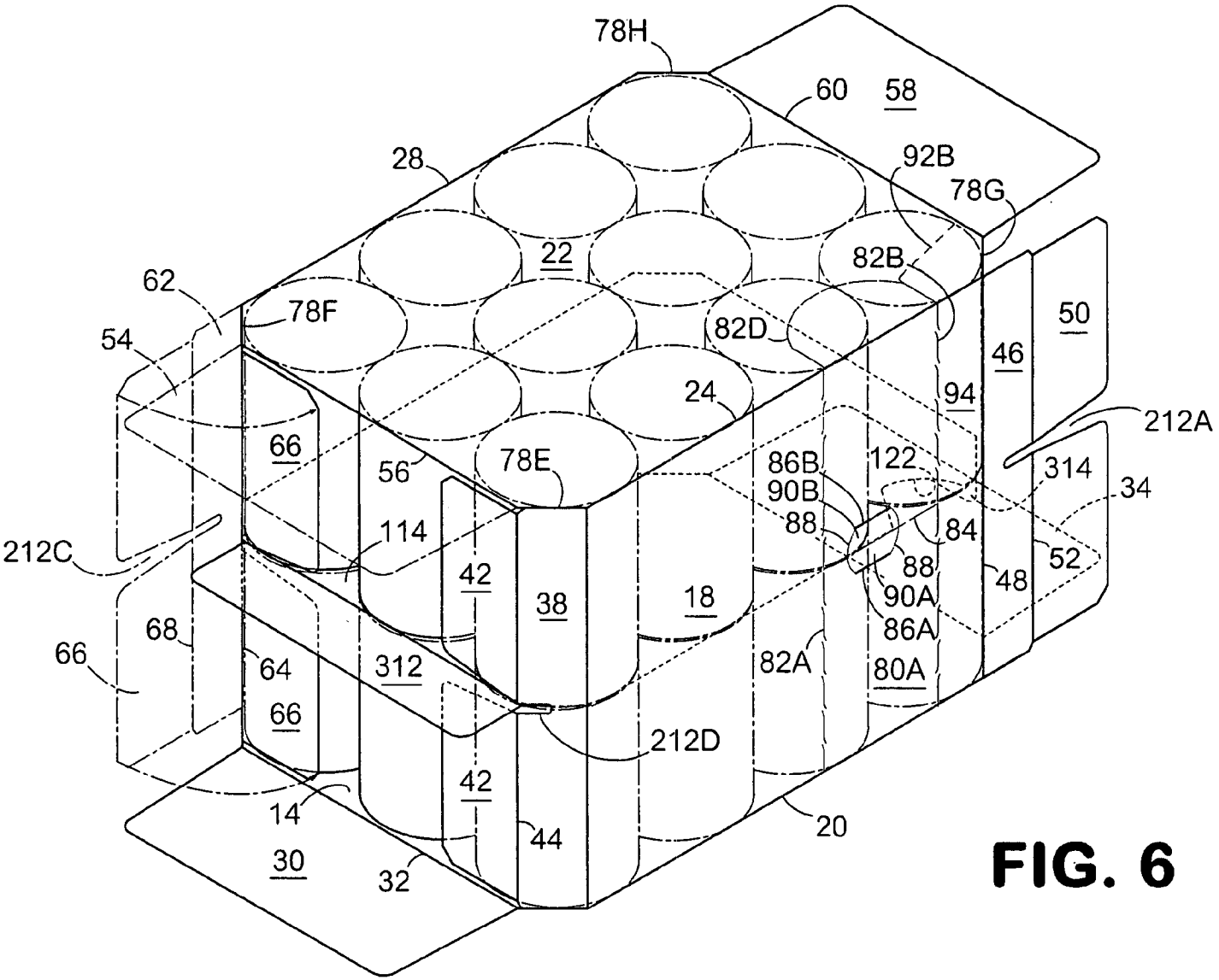
FIG. 6 is a perspective view of a carton formed from the blank of FIG. 5 and the separator pad of FIG. 5A that has been placed between two layers of cans and moved into the carton in which an angle panel and side end flap with a slit has been closed with the leading flap of the separator pad extending through the slit.
Figure 7:
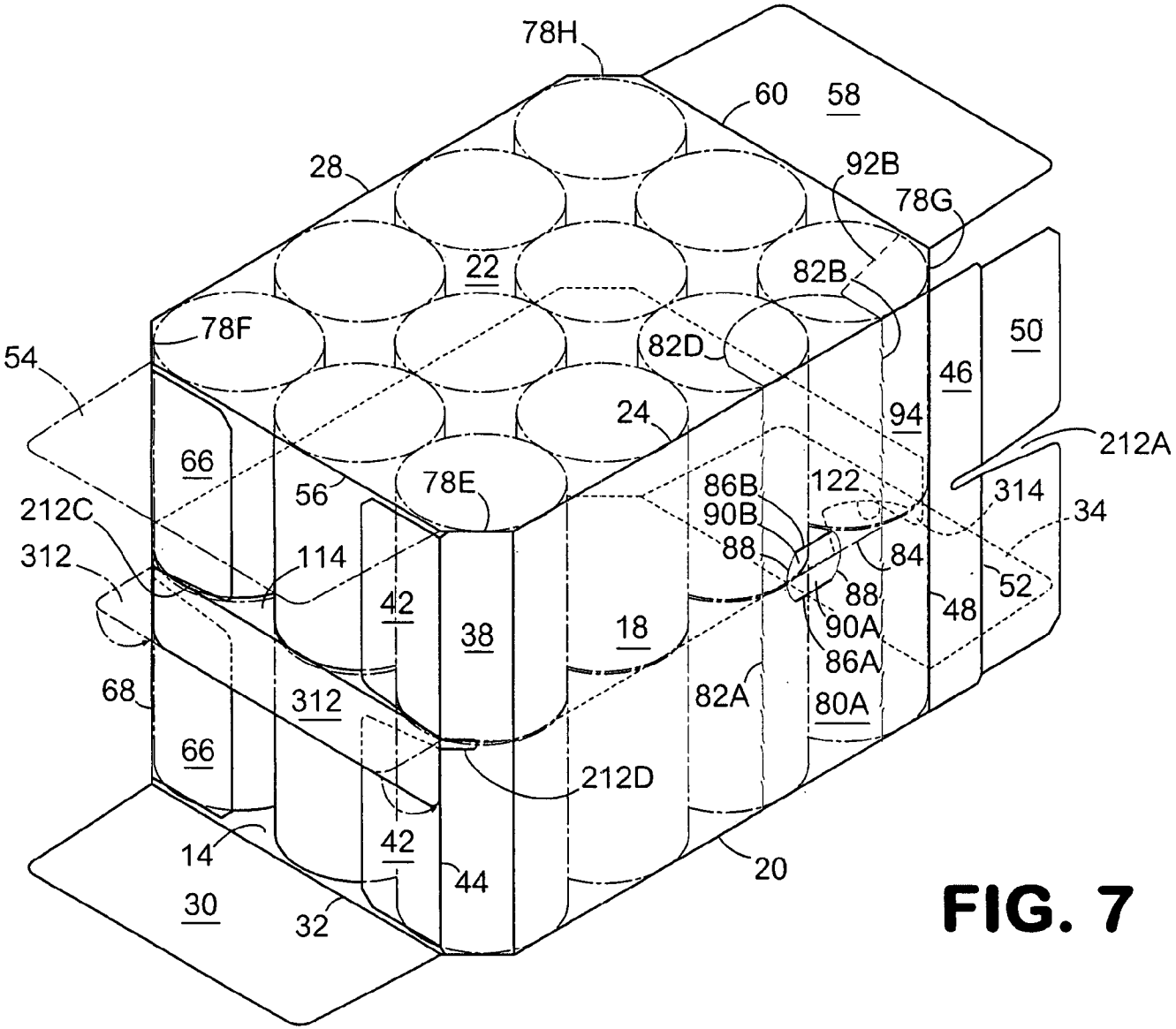
FIG. 7 is a perspective view of the carton of FIG. 6 in which both angle panels and side end flaps on an end of the carton have been closed and the leading flap extending through the slits can be folded down prior to folding and closing the bottom end flap and the top end flap.

Another embodiment of this invention is illustrated in FIGS. 5–7. A plan view of the blank for forming the carton of this embodiment is illustrated in FIG. 5. The numbering on the blank 210 is identical to the numbering in the blank 10 as shown in FIG. 1 except for omissions and additions as described. The side end closures on the blank 210 have slits 212A–D in the side end flaps 50, 74, 66 and 42. These slits 212A–D may extend a short distance into side angle panels 46, 70, 62 and 38. These slits 212A–D are designed for receiving the interlocking separator pad which will be discussed infra. These slits 212A–D are located in the side end closures at a distance from the bottom panel 14 when the carton is formed that is approximately equal to the height of articles or cans to be contained in the bottom layer. In other words, these slits are located so the interlocking separator pad can be placed between the two layers of articles or cans.

The blank 310 for the interlocking separator pad for the carton formed from blank 210 is illustrated in FIG. 5A where the numbers are identical to those in FIG. 1A except for omissions and additions as described. This blank 310 has a leading flap 312 attached to the separator pad 114 by fold line 116. It also has a trailing flap 314 attached to separator pad 114 by fold line 316. The height H of the leading flap 312 and the trailing flap 314 must not be greater than the height of a can or an article to be contained in the carton or it will be difficult to fold the flaps into proper position.

The blank 210 of this embodiment is formed into a carton sleeve in the same way as the blank 10 of FIG. 1 is formed into a carton sleeve. The blank 310 for interlocking separator panel is placed upon a layer of cans or articles in three rows. A top layer cans or articles in three rows can then be placed on top of the separator pad 114 and placed in the carton sleeve as illustrated in FIG. 6. The side end closures, each of which consists of a side angle panel and side end flap, are then closed. The slits 212A–D are pushed along the leading flap 312 and trailing flap 314 until all side end closures on the carton are closed. As illustrated in FIG. 6, the leading flap 312 will extend through slit 212C in side angle panel 62 and side end flap 66 and extends through slit 212D in side angle panel 38 and side end flap 42. It should be pointed out that these slits can be formed in the side end flap alone and not extend into the side angle panel depending upon the specific design of the carton and separator pad. The leading flap 312 and trailing flap 314 can now be folded up or down. The bottom end flaps 30 and 34 and top end flaps 54 and 58 can now be closed and glued to the respective side end flaps, 42, 50, 66 and 74. The leading flap 312 and trailing flap 314 are tightly lodged between the side end flaps and top end flap on bottom end flap. The separator pad 114 for this embodiment is interlocked with the side end closures of the carton by locking edges 318A–D which hold the separator pad 114 firmly inside of the side end flaps 42, 50, 66 and 74 in the interlocked position. This separator pad 114 is held in this interlocked position without being glued to the carton, which eliminates a step in the loading and sealing of the carton. The locking edges 318A–D interlock with the slits 212A–D to hold the interlocking separator pad 114 in proper position as cans are removed from the carton from one or both layers. The slits 212A–D prevent the separator pad 114 from moving towards the bottom panel or top panel. The leading flap 312 and trailing flap 314 are lodged between the side end flaps and the top or bottom end flaps. This will prevent the separator pad 114 from moving as cans are being removed from the carton through a dispenser or end of the carton. The height of the leading flap and trailing flap must not be greater than the height of a can contained in the carton. Preferably the height H of the leading flap 312 and trailing flap 314 is slightly less than the height of a can to be contained in the carton.

Cans can be removed from the carton of this embodiment in the same way as cans are removed from the dispenser opening B of the first embodiment as illustrated in FIG. 4.

While the invention has been disclosed in its preferred forms, it will be apparent to those skilled in the art that many modifications, additions, and deletions can be made therein without departing from the spirit and scope of the invention and its equivalents as set forth in the following claims.

Therefore, having thus described the invention, at least the following is claimed:

1. An article carrying carton with two ends loaded with a plurality of articles comprising:

(a) said carton having a bottom panel, top panel and foldably attached adjoining side panels with each end being an interlocking end which is closed by a top end flap foldably attached to the top panel, a bottom end flap foldably attached to the bottom panel and an angle panel foldably attached to each side panel and a side end flap foldably attached to each angle panel, each said angle panel and foldably attached side end flap constituting a side end closure, with each side end closure having an aperture, with said side end closures being held together by securing means;

(b) two layers of articles with at least two rows of articles in each layer; and (c) an interlocking separator pad with two ends, each of which is an interlocking end, said pad having four angled corners, each of which is adjacent an angle panel of the carton, said pad being located between the two layers of articles with each end of the pad having an interlocking end portion of the pad that is interlocked with said apertures in the side end closures on the end of the carton to which said end of the pad is adjacent, with at least one end of the pad having a leading flap that is folded into a plane which is at least substantially perpendicular to the bottom panel of the carton.

2. The carton loaded with a plurality of articles of claim 1, in which the means far securing each side end closure of the carton is by gluing the top end flap and bottom end flap to the side end flaps.

3. The carton loaded with a plurality of articles of claim 1, in which the articles are generally cylindrical containers with a curved circumference and with two ends with an axis extending between the two ends, said axes of the containers being perpendicular to the separator pad, with the containers being arranged in each layer that each angle panel of the carton is adjacent to the curved circumference of a container.

4. The carton with a plurality of articles of claim 3, in which each end portion of the separator pad is interlocked with the side end closures on one end of the carton, in which the aperture in each side end closure is a slot, with each interlocking end portion of a separator pad having a plurality of tabs each of which extends through a slot in a side end closure thereby interlocking the separator pad with the side end closures, with each leading flap of the separator pad being lodged between the side end closures on one end of the carton and an adjacent layer of containers in the carton.

5. The carton with a plurality of articles of claim 4, in which each side end closure has one slot and each end portion of the separator pad has two tabs.

6. The carton with a plurality of articles of claim 3, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

7. The carton with a plurality of articles of claim 6, in which said bottom tear line in the side panel of the carton is located from the closest side end flap by a distance which is sufficient to prevent a container adjacent the closest side end flap from rolling out of the opening formed when the dispenser flap is removed when the carton is resting on the end where said closest side end flap is located, but with said bottom tear line not being so far from said closest side end flap to prevent the removal through said opening of a container adjacent said closest side end flap.

8. The carton with a plurality of articles of claim 7, in which the tear lines that extend into the adjoining bottom panel and adjoining top panel of the carton extend into each said panel far enough to permit a person to grasp the adjacent end of a container through the opening formed when the dispenser flap is removed.

9. The carton with a plurality of articles of claim 8, in which a tear line interconnects said bottom tear line and top tear line in said side panel of the carton to facilitate opening said dispenser flap.

10. The carton with a plurality of articles of claim 9, which has at least one finger flap in the dispenser flap adjacent to the tear line connecting the top and bottom tear lines together in said side panel to facilitate tearing the dispenser flap open.

11. The carton with a plurality of articles of claim 10, which has a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

12. The carton with a plurality of articles of claim 4, said carton having a dispenser flap which when removed provides an opening which permits the removal of the containers from each layer, said dispenser flap formed by a bottom tear line in a side panel which is at least substantially parallel to an end of the carton and a cop tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

13. The carton with a plurality of articles of claim 12, in which said bottom tear line in the side panel of the carton is located from the closest side end flap by a distance which is sufficient to prevent a container adjacent the closest side end flap from rolling out of the opening formed when the dispenser flap is removed when the carton is resting on the end where said closest side end flap is located, but with said bottom tear line not being so far from said closest side end flap to prevent the removal through said opening of a container adjacent said closest side end flap.

14. The carton with a plurality of articles of claim 13, in which the tear lines that extend into the adjoining bottom panel and adjoining top panel of the carton extend into each said panel far enough to permit a person to grasp the adjacent end of a container through the opening formed when the dispenser flap is removed.

15. The carton with a plurality of articles of claim 14, in which a tear line interconnects said bottom tear line and top tear line in said side panel of the carton to facilitate opening said dispenser flap.

16. The carton with a plurality of articles of claim 15, which has at least one finger flap in the dispenser flap adjacent to the tear fine connecting the top and bottom tear lines together in said side panel to facilitate tearing the dispenser flap open.

17. The carton with a plurality of articles of claim 16, which has a tear line in the bottom panel between the bottom tear line and the closest bottom end flap and a tear line in the top panel between the bottom tear line and the closest top end flap to enable a person to move that portion of the side panel between the bottom tear line and the closest side end flap a sufficient distance to permit the easy removal of containers from the opening formed by the removal of the dispenser flap.

18. The carton with a plurality of articles of claim 4, in which there are three rows of containers in each layer.

19. A carton with two ends for carrying a plurality of containers in two layers with at least two rows in each layer and an interlocking separator pad for keeping the layers of containers separate comprising:

(a) said carton having a bottom panel, top panel and foldably attached adjoining side panels with each end being an interlocking end which is closed by a top end flap foldably attached to the top panel, a bottom end flap foldably attached to the bottom panel and an angle panel foldably attached to each side panel and a side end flap foldably attached to each angle panel, each said angle panel and foldably attached side end flap constituting a side end closure, with each side end closure having an aperture, wit said side end closures being held together by securing means; and (b) an interlocking separator pad with two ends, each of which is an interlocking end, said pad having four angled corners, each of which is adjacent an angle panel of the carton, said pad being designed to be located between the two layers of containers with each end of the pad having an interlocking end portion of the pad that is interlocked with said apertures in the side end closures on the end of the carton to which said end of the pad is adjacent, with at least one end of the pad having a leading flap that is folded into a plane which is at least substantially perpendicular to the bottom panel of the carton.

20. The carton and interlocking separator pad of claim 19, in which each end portion of the separator pad is interlocked with the side end closures on one end of the carton, in which the aperture in each side end closure on each end of the carton is a slot, with each interlocking end portion of a separator pad having a plurality of tabs, each of which extends through a slot in a side end closure, thereby interlocking the separator pad with the side end closures.

21. The carton and interlocking separator pad of claim 20, said carton having a dispenser flap which when removed provides an opening which permits the removal of the containers from each layer, said dispenser flap formed by a bottom tear line in a side panel which is at least substantially parallel to an end of the carton and a top tear line spaced apart from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

22. A blank for a carton with two ends for carrying a plurality of containers in two layers with at least two rows in each layer and an interlocking separator pad for keeping the layers of containers separated comprising:

(a) said carton blank having a bottom panel, top panel and foldably attached adjoining side panel, with each end being an interlocking end which is closed by a top end flap foldably attached to the top panel, a bottom end flap foldably attached to the bottom panel and an angle panel foldably attached to each side panel and a side end flap foldably attached to each angle panel, each said angle panel and foldably attached side end flap constituting a side end closure, with each side end closure having an aperture, with said side end closures being designed to be held together by securing means; and (b) an interlocking separator pad with two ends, each of which is an interlocking end, said pad having four angled corners, each of which is designed to be adjacent an angle panel of the carton, said pad being designed to be located between the two layers of articles with each end of the pad having an interlocking end portion of the pad that is designed to be interlocked with said apertures in the side end closures on the end of the canon to which said end of the pad is to be adjacent, with at least one end of the pad having a leading flap that is designed to be folded into a plane which is at least substantially perpendicular to the bottom panel of the carton.

23. The blank and interlocking separator pad of claim 22, in which the end portion of the separator pad is capable of being interlocked with the side end closures on one end of the carton, in which the aperture in each side end closure is a slot, with each interlocking end portion of a separator pad having a plurality of tabs, each of which is capable of extending through a slot in a side end closure thereby interlocking the separator pad with the side end closures, with each leading flap of the separator pad being capable of being lodged between a side end closure of one end of the carton and an adjacent layer of containers in the carton when the carton is formed and loaded with containers.

24. The blank and separator pad of claim 23, said carton having a dispenser flap which when removed provides an opening which permits the removal of the containers from each layer, said dispenser flap fanned by a bottom tear line in a side panel which is at least substantially parallel to an end of the carton and a top tear line spaced aped from said bottom tear line and is at least substantially parallel thereto, said bottom and top tear lines extending into the adjoining top panel and interconnecting each other and extending into the adjoining bottom panel and interconnecting each other, said parallel tear lines being spaced apart by a distance sufficient to permit the removal through said opening of a container by a person.

25. The carton loaded with a plurality of articles of claim 3, in which the top panel and bottom panel each have four angled corners, each of which is adjacent an angle panel of the carton.

26. The canon loaded with a plurality of articles of claim 4, in which the top panel and bottom panel each have four angled corners, each of which is adjacent an angle panel of the carton.

27. The carton and interlocking separator pad of claim 19, in which the top panel and bottom panel each have four angled corners, each of which is adjacent an angle panel of the carton.

28. The carton and interlocking separator pad of claim 20, in which the top panel and bottom panel each have four angled corners, each of which is adjacent an angle panel of the carton.

29. The blank and interlocking separator pad of claim 22, in which the top panel and bottom panel each have four angled corners, each of which is adjacent an angle panel of the carton.

30. A container carrying carton with two ends loaded with a plurality of generally cylindrical containers comprising:

(a) said carton having a bottom panel, top panel and foldably attached adjoining side panels with each end being an interlocking end which is closed by a top end flap foldably attached to the top panel, a bottom end flap foldably attached to the bottom panel and an angle panel foldably attached to each side panel and a side end flap foldably attached to each angle panel, each said angle panel and foldably attached side end flap constituting a side end closure, with each side end closure having a slot, with said side end closures being held together by glue;

(b) two layers of generally cylindrical containers at least two rows of containers in each layer; and (c) an interlocking separator pad with two ends, each of which is an interlocking end, said pad having four angled corners, each of which is adjacent an angle panel of the carton, said pad being located between the two layers of containers with each end of the pad having two tabs each of which extends trough a slot in a side end closure thereby interlocking the separator pad with the side end closures with at least one end of the pad having a leading flap being lodged between the side end closures on one end of the carton and an adjacent layer of containers in the carton.

31. A carton loaded with a plurality of containers, comprising:

a bottom panel;

a top panel;

a first side panel;

a second side panel;

a first end at least partially closed by a first top end flap foldably attached to the top panel, a first bottom end flap foldably attached to the bottom panel, a first side end panel and a second side end panel;

a second end at least partially closed by a plurality of second end flaps;

two layers of generally cylindrical containers with at least two rows of containers in each layer; and a separator pad disposed between the two layers of containers, the separator pad having a first end and a second end, the first end having a leading flap and a first tab, the first tab being interlocked with a first aperture extending at least through the first side end panel, and the leading flap being folded into a plane which is at least substantially perpendicular to the bottom panel, wherein each container has two ends and an axis extending between the two ends, the axes of the containers being generally perpendicular to the separator pad.

32. The carton and plurality of containers of claim 31, further comprising:

a first angle panel connecting the first side end panel to the first side panel; and a second angle panel connecting the second side end panel to the second side panel.

33. The carton and plurality of containers of claim 32, wherein the first end of the separator pad has two angled corners, each angled corner being adjacent to one of the angle panels.

34. The carton and plurality of containers of claim 32, wherein the separator pad further comprises a second tab extending through a second aperture, the second aperture extending at least through the second side end panel and the second angle panel.

35. The carton and plurality of containers of claim 32, wherein the second end of the separator pad has two second end tabs, each second end tab extending through an aperture in the second plurality of end flaps.

36. A carton loaded with a plurality of containers, comprising:

a bottom panel;

a top panel;

a first side panel;

a second side panel;

a first end at least partially closed by a first plurality of end flaps, the first plurality of end flaps comprising a first top end flap foldably attached to the top panel, a first bottom end flap foldably attached to the bottom panel, a first angle panel foldably connected to the first side panel, a first side end panel foldably connected to the first angle panel, a second angle panel foldably connected to the second side panel, and a second side end panel foldably connected to the second angle panel;

a second end at least partially closed by a plurality of second end flaps;

two layers of generally cylindrical containers with at least two rows of containers in each layer; and a separator pad disposed between the two layers of containers, the separator pad having a first and a second end, the first end having a first tab and a second tab, the first tab being interlocked with a first aperture extending at least through the first side end panel and the first angled panel, and the second tab being interlocked with a second aperture extending at least through the second side end panel and the second angled panel, wherein each container has two ends and an axis extending between the two ends, the axes of the containers being generally perpendicular to the separator pad.

37. The carton and plurality of containers of claim 36, wherein the first end of the separator pad has two angled corners, each angled corner being adjacent to one of the angle panels.

38. The carton and plurality of containers of claim 37, wherein the first end of the separator pad comprises a leading flap folded into a plane which is at least substantially perpendicular to the bottom panel.

39. The carton and plurality of containers of claim 37, wherein the second end of the separator pad has two second end tabs, each second end tab extending trough an aperture in the second plurality of end flaps.

* * * * *